US008806667B2

(12) United States Patent
Pfanner et al.

(10) Patent No.: US 8,806,667 B2
(45) Date of Patent: Aug. 19, 2014

(54) FACE GUARD FOR FASTENING TO A PROTECTIVE HELMET, IN PARTICULAR FOR FORESTRY WORKERS

(75) Inventors: Anton Pfanner, Hohenems (AT); Martin Greber, Götzis (AT)

(73) Assignee: Pfanner Schutzbekleidung GmbH, Hohenems (AT)

( * ) Notice: Subject to any disclaimer, the term of this patent is extended or adjusted under 35 U.S.C. 154(b) by 0 days.

(21) Appl. No.: 13/809,071

(22) PCT Filed: Jul. 12, 2011

(86) PCT No.: PCT/EP2011/061883

§ 371 (c)(1),
(2), (4) Date: Feb. 21, 2013

(87) PCT Pub. No.: WO2012/007476

PCT Pub. Date: Jan. 19, 2012

(65) Prior Publication Data

US 2013/0212787 A1 Aug. 22, 2013

(30) Foreign Application Priority Data

Jul. 13, 2010 (DE) ..... 10 2010 027 015

(51) Int. Cl.
*A42B 1/08* (2006.01)
*A42B 3/22* (2006.01)

(52) U.S. Cl.
CPC ..... *A42B 3/225* (2013.01); *A42B 3/222* (2013.01)
USPC ..... 2/424

(58) Field of Classification Search
USPC ..... 2/424, 410, 425, 9, 10, 12, 15
See application file for complete search history.

(56) References Cited

U.S. PATENT DOCUMENTS 4,621,377 A * 11/1986 Pennell ..... 2/6.4
5,604,930 A * 2/1997 Petit et al. ..... 2/6.5

(Continued)

FOREIGN PATENT DOCUMENTS

DE 2907056 A1 8/1980
DE 3314595 A1 11/1983

(Continued)

OTHER PUBLICATIONS

International Search Report dated Nov. 3, 2011, issued in International Application PCT/EP2011/061883.

*Primary Examiner* — Tejash Patel
(74) *Attorney, Agent, or Firm* — Fitch, Even, Tabin & Flannery, LLP

(57) ABSTRACT

A face protection to be fastened to a protective helmet, particularly for forestry workers, is described. A visor has two retaining arms and two bearing devices which can be fastened on the inside of a helmet shell for the retaining arms for pivoting the visor between an operating position in which the visor is swung downwards and protects the face, and a parking position in which the visor is swung upwards. Each retaining arm extends towards the free end thereof which can be connected to the bearing device from the visor substantially parallel to and at such a distance from the visor that a slot is formed between the retaining arm and the visor through which slot the helmet shell extends in the parking position, and that, in the parking position, the visor is arranged close-fitting on the outer surface of the helmet shell.

4 Claims, 9 Drawing Sheets

(56) References Cited

U.S. PATENT DOCUMENTS

Figure 1:
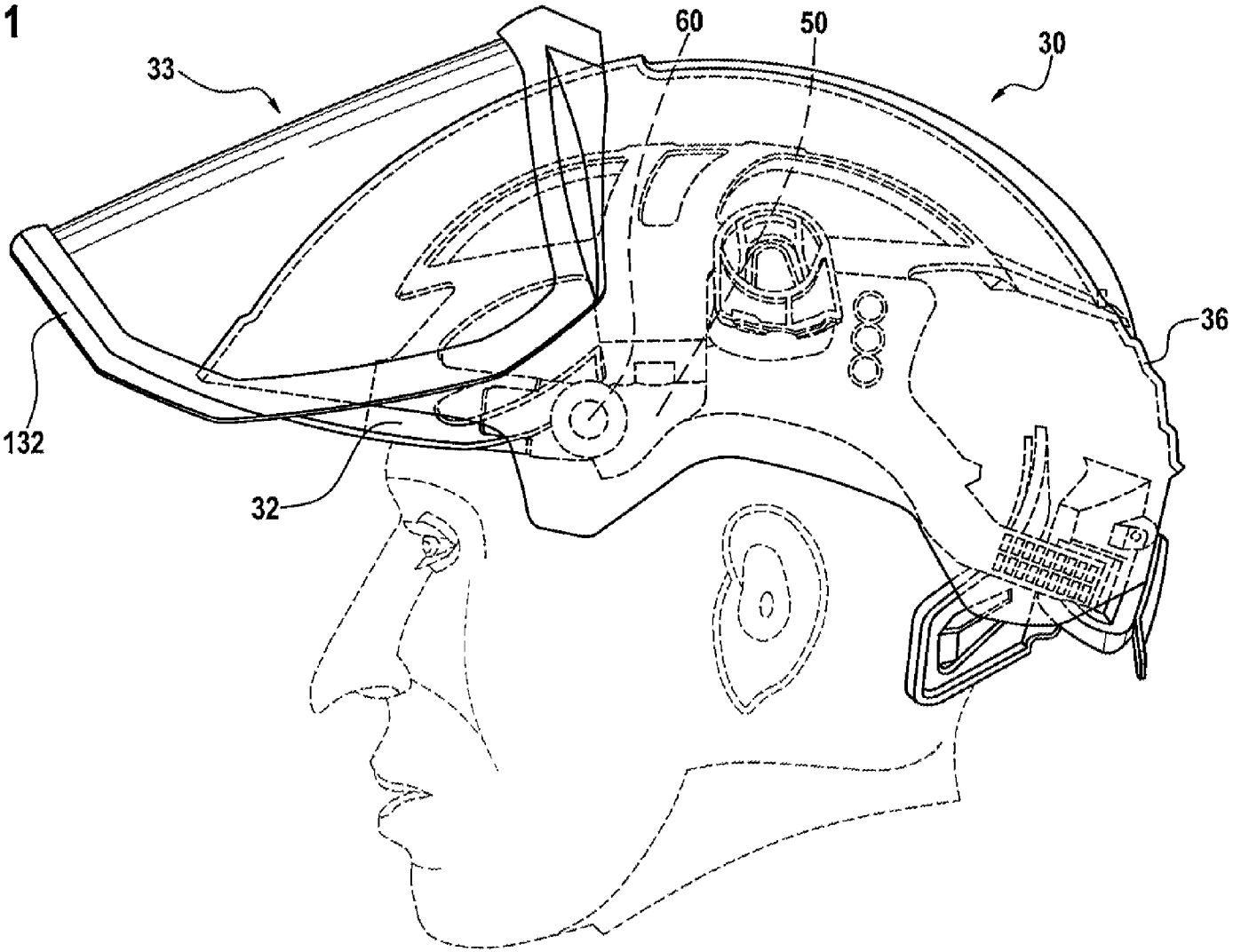

| | | | | |
|---|---|---|---|---|
| 6,820,285 | B2 * | 11/2004 | Bataille et al. | 2/422 |
| 8,069,499 | B2 * | 12/2011 | Isobe | 2/424 |

FOREIGN PATENT DOCUMENTS

| | | | |
|---|---|---|---|
| DE | 2826636 | C2 | 5/1987 |
| DE | 8714490 | U1 | 9/1988 |
| DE | 3314595 | C2 | 11/1991 |
| DE | 9410596 | U1 | 8/1994 |
| DE | 3590667 | C2 | 9/1996 |
| DE | 29708134 | U1 | 8/1997 |
| DE | 102006013025 | A1 | 10/2007 |
| EP | 0130108 | A2 | 1/1985 |
| FR | 2352507 | A2 | 12/1977 |
| GB | 2014432 | A | 8/1979 |
| GB | 2084859 | A | 4/1982 |
| WO | 2008/033189 | A2 | 3/2008 |

* cited by examiner

FACE GUARD FOR FASTENING TO A PROTECTIVE HELMET, IN PARTICULAR FOR FORESTRY WORKERS

CROSS-REFERENCE TO RELATED APPLICATIONS

This application is a U.S. National Stage filing under 35 U.S.C. 371 of International Application No. PCT/EP2011/061883, filed Jul. 12, 2011, designating the United States and claims the benefit of foreign priority from German Patent Application Number 10 2010 027 015.6, filed Jul. 13, 2010, the entire disclosures of which are incorporated herein by reference.

The invention relates to a face protection to be fastened to a protective helmet, particularly for forestry workers, comprising a visor comprising two retaining arms and two bearing devices mountable on a helmet shell of a helmet for the retaining arms for pivoting the visor between two positions, an operating position in which the visor is pivoted downwards and protects the face, and a parking position in which the visor is pivoted upwards.

A safety helmet comprising a pivotable face protection of the abovementioned type is known from the document DE 35 90 667 C2. The bearing devices for the retaining arms of the visor are fixed to the outside of the helmet shell. In such a safety helmet it is disadvantageous that, in use, obstacles the helmet passes may get caught behind the support arms and/or the visor and in that way impede the wearer of the helmet on duty or rip the helmet off his head and thereby imperil the wearer. Particularly if work in the forest is done with the visor pivoted upwards the upper edge of the visor is located in a wide distance from the outer side of the helmet so that in this case branches may easily get between the helmet and the visor and tear the visor or the helmet or the helmet off the head.

Another protective helmet of this type is known from the document DE 87 14 490 U1. In this protective helmet a face and an ear protection are fixed on the outside of the helmet by means of a common connection element.

Other documents showing the installation of helmet accessories such as a face protection on the outside of a protective helmet are the DE 28 26 636 C2, DE 29 07 056 A1, DE 33 14 595 C2, DE 35 90 667 C2, DE 97 10 596 U1 and DE 297 08 134 U1. The wearer of the helmet may also be impeded or imperilled in the field by the protective helmets known from these documents if obstacles get caught on the support arms of the visor.

In a protective helmet known from the document DE 10 2006 013 25 A1, a mounting bracket of the visor is hinged to an axis of rotation below a pivotable lateral area on the outer surface of a helmet shell. The design of the visor is, in this case, also selected so that there risk that obstacles may get caught on the mounting bracket of the visor is not excluded.

The document WO 2008/0331 89 A2 shows a fire fighters' helmet comprising a visor hinged to the lower edge of an inner shell of the helmet. The storage position of the visor is apparently located between an inner and an outer shell. This type of face protection can only be used with a rather special helmet design.

It is the object of the invention to provide a face protection of the type mentioned in the beginning and known from the document first mentioned so that the risk that obstacles may get caught on the visor and/or its support arms does not exist in the two positions of the visor.

According to the invention, this object is solved by each bearing device being designed for an installation on the inside of the helmet shell and by each retaining arm extending from the visor to its free end connectable or connected to the bearing device substantially parallel and in such a distance to the visor that a slot is formed between the retaining arm and the visor through which the helmet shell extends in the parking position, and by the visor being, in the parking position, arranged close-fitting on the outer surface the helmet shell. In the face protection according to the invention the visor is guided by the retaining arms so that there is hardly any distance between its upper edge and the outer surface of the helmet in the hinged-up position and in the hinged-down position. Therefore there are no engagement possibilities for obstacles on the face protection according to the invention.

The subject matter of the subclaims is advantageous embodiments of the invention.

In one embodiment of the face protection according to the invention the free end of each retaining arm is formed as a ring bearing bushing, and each bearing device comprises a bearing pivot for the accommodation the ring bearing bushing. Each support arm and the bearing device allocated to it thus form a visor supporting joint securely located within the perimeter of the helmet. In the parking position of the visor, the visor, together with the helmet shell, protects the support arm against the engagement of obstacles. In the operating position of the visor, each support arm is located behind the visor, and the lateral edges of the visor tightly abut to the outer surface of the helmet shell. The frame of the visor abuts to the front edge of the helmet shell. In the operating position as well, the visor and/or its support arms therefore offer no engagement point for obstacles.

In a further embodiment of the face protection according to the invention, each bearing device is formed as a part of a plug-in coupling pluggable on the other part of the plug-in coupling installed on the inside of the helmet shell. The face protection can thus be effortlessly attached to the helmet and detached from the helmet by the user of the helmet.

In a further embodiment of the face protection according to the invention the bearing pivot of each plug-in coupling part comprises axially protruding, elastically flexible tappets on which the ring bearing bushing can be snapped. The fixation of the face protection on the inside of the helmet may, in this way, be effected by means of snap-on connection by the user of the helmet.

In a further embodiment of the face protection according to the invention, a spring-biased locking element is provided which engages in the ring bearing bushing from the outside and can be entrained by the ring bearing bushing so as to releasably and positively retain the visor in its one or other position. In this way it can be ensured in a simple manner that the visor maintains the position selected by the user.

In a further embodiment of the face protection according to the invention, the spring-biased locking element comprises a roll rotatably supported at one end of a rod, the other end of the rod extending through a pivot bearing and a pressure spring for generating the spring pre-load being positioned on the rod between the pivot bearing and a shoulder. The locking of the visor in the selected position is thus effected by a simple low-wear element not requiring any maintenance. The plug-in coupling part formed as a connector and containing the spring pre-loaded locking element may be simply replaced by a new connector, if required.

Figure 2:
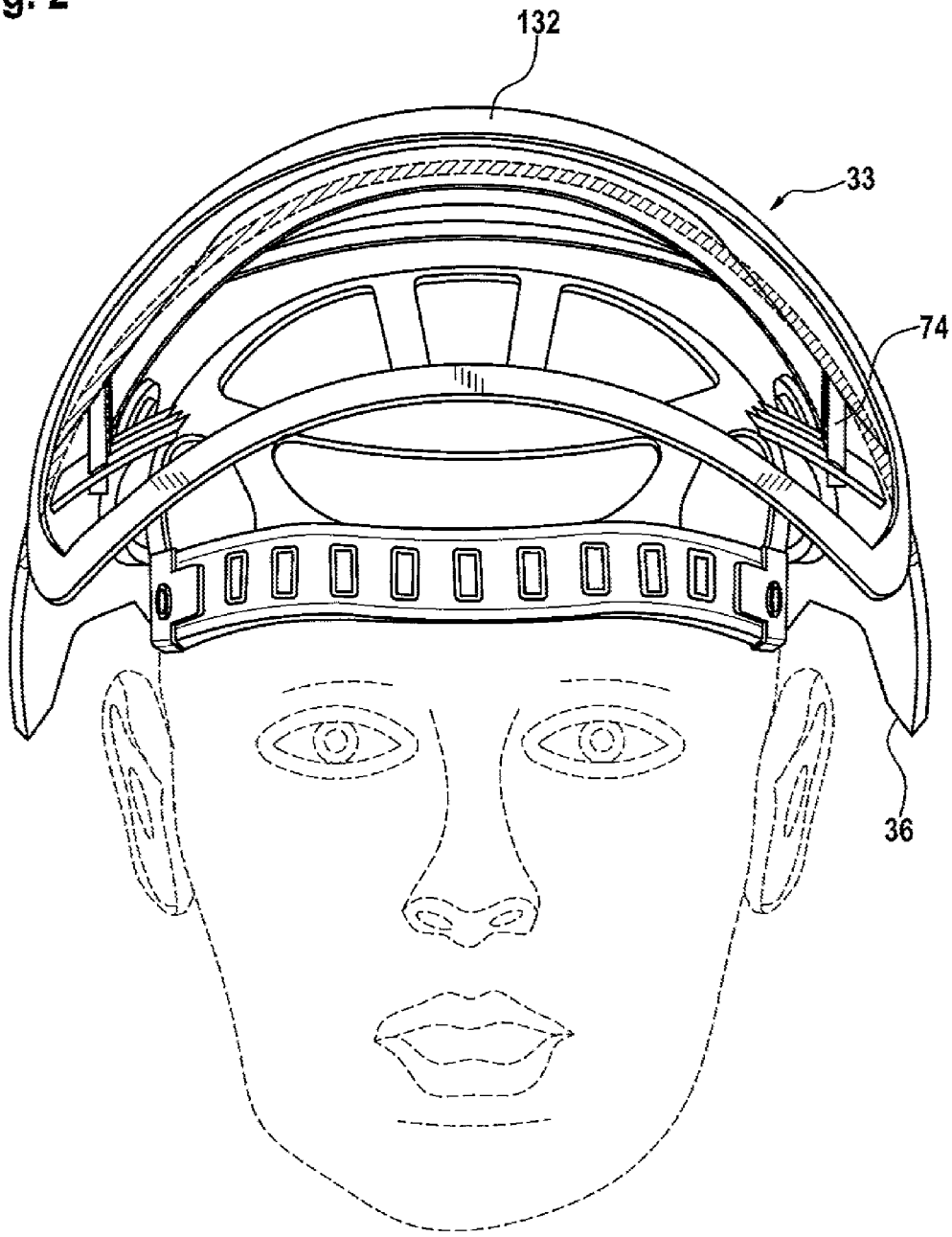
Figure 3:
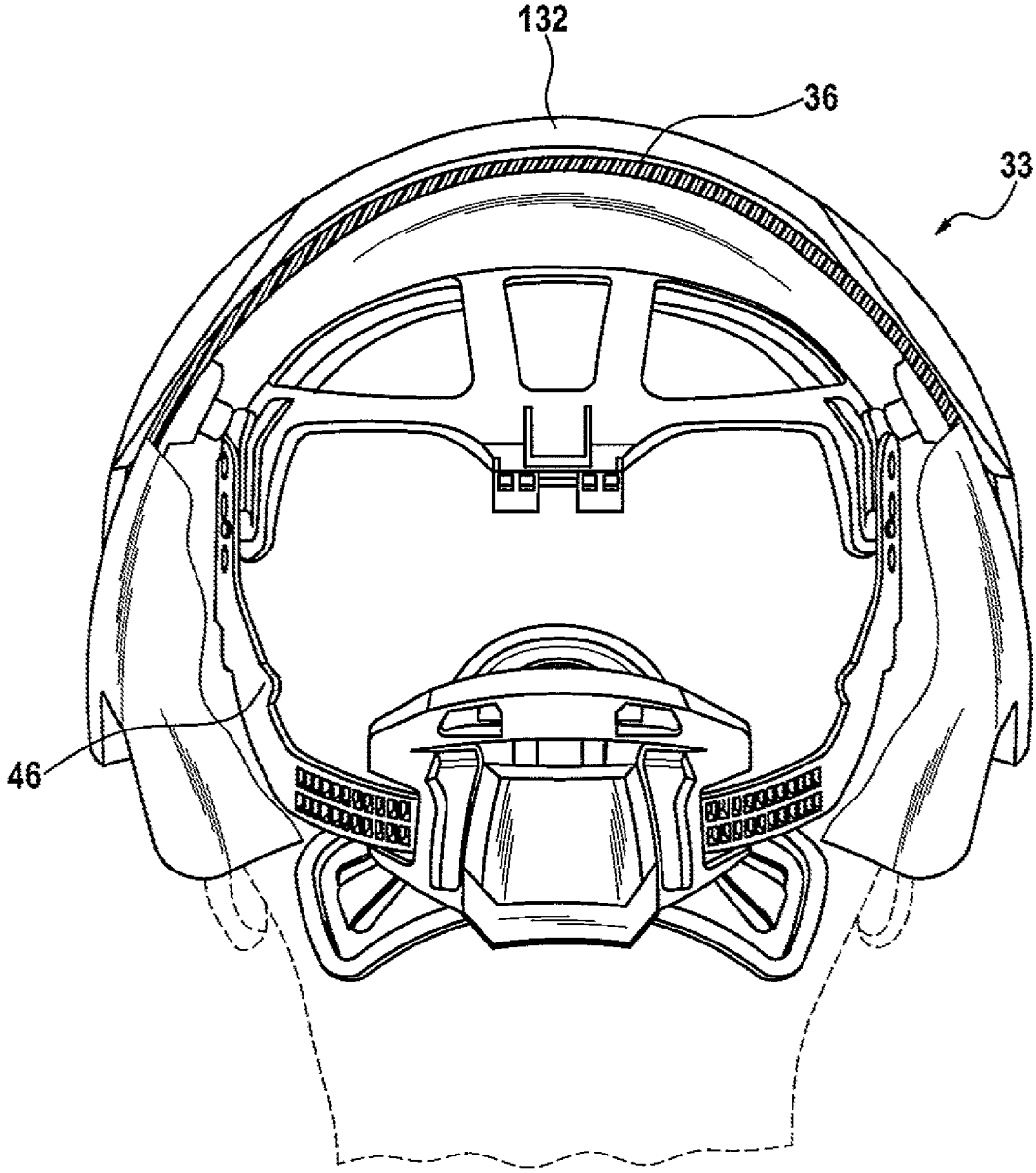
Figure 4:
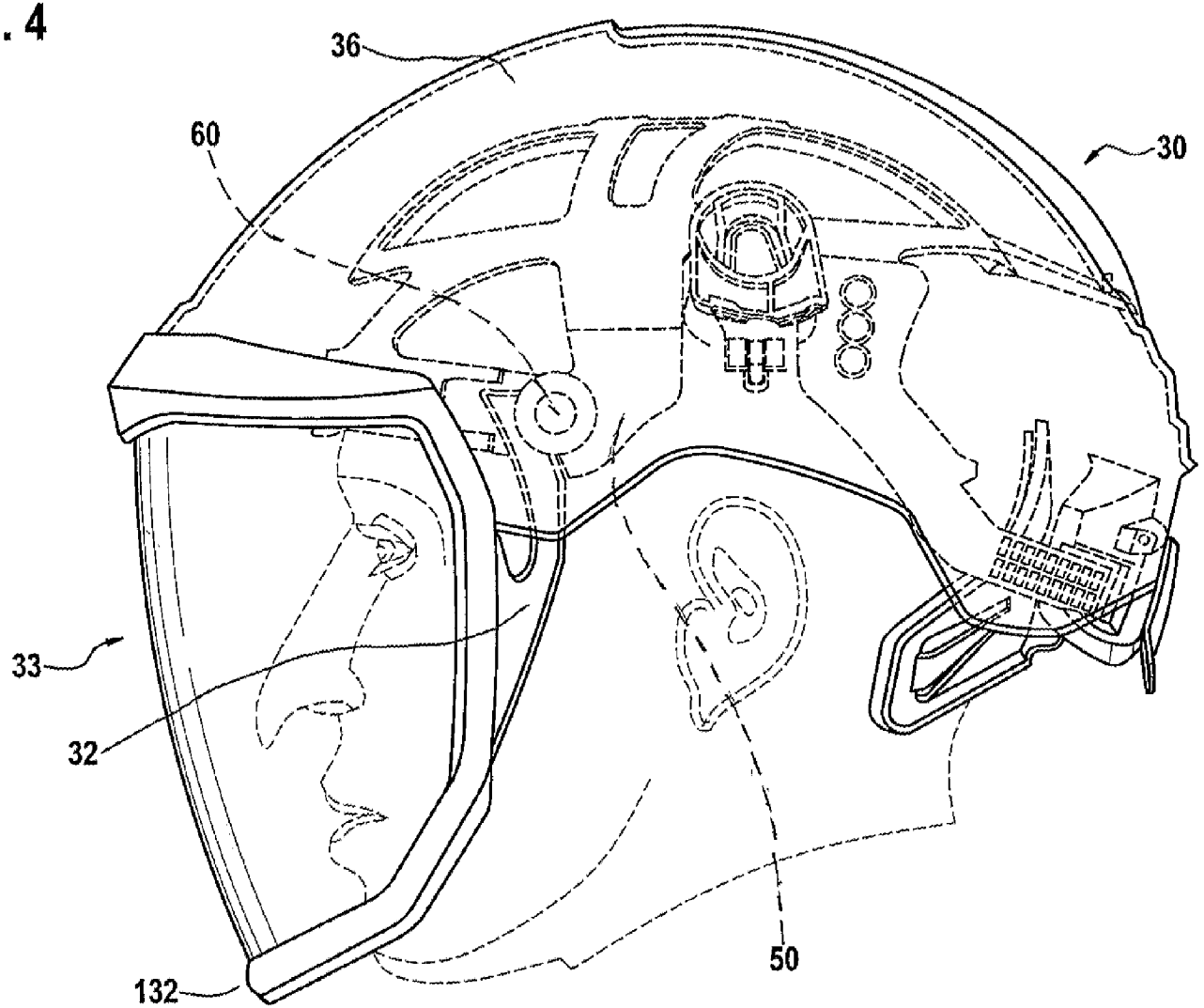
Figure 5:
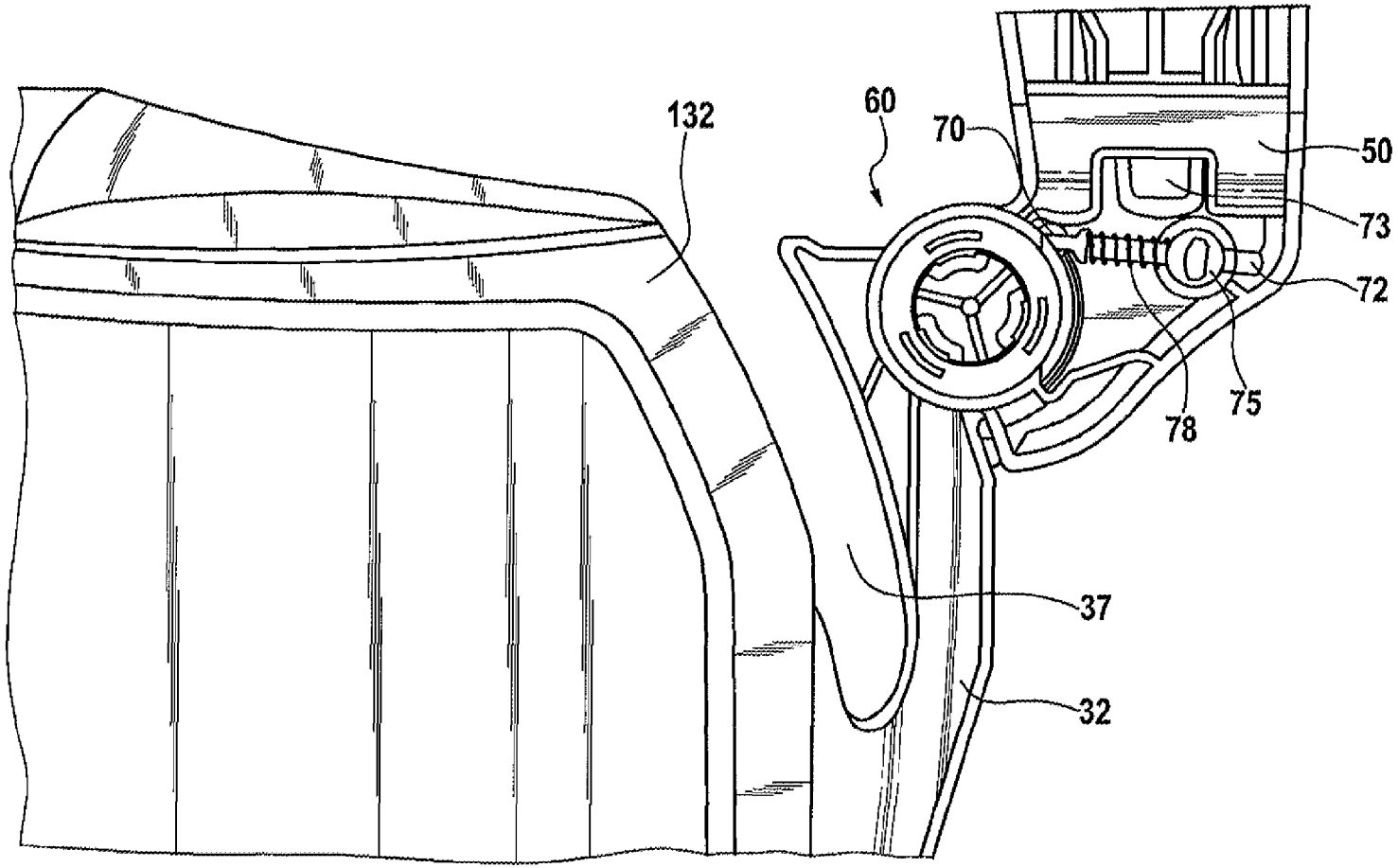
Figure 6:
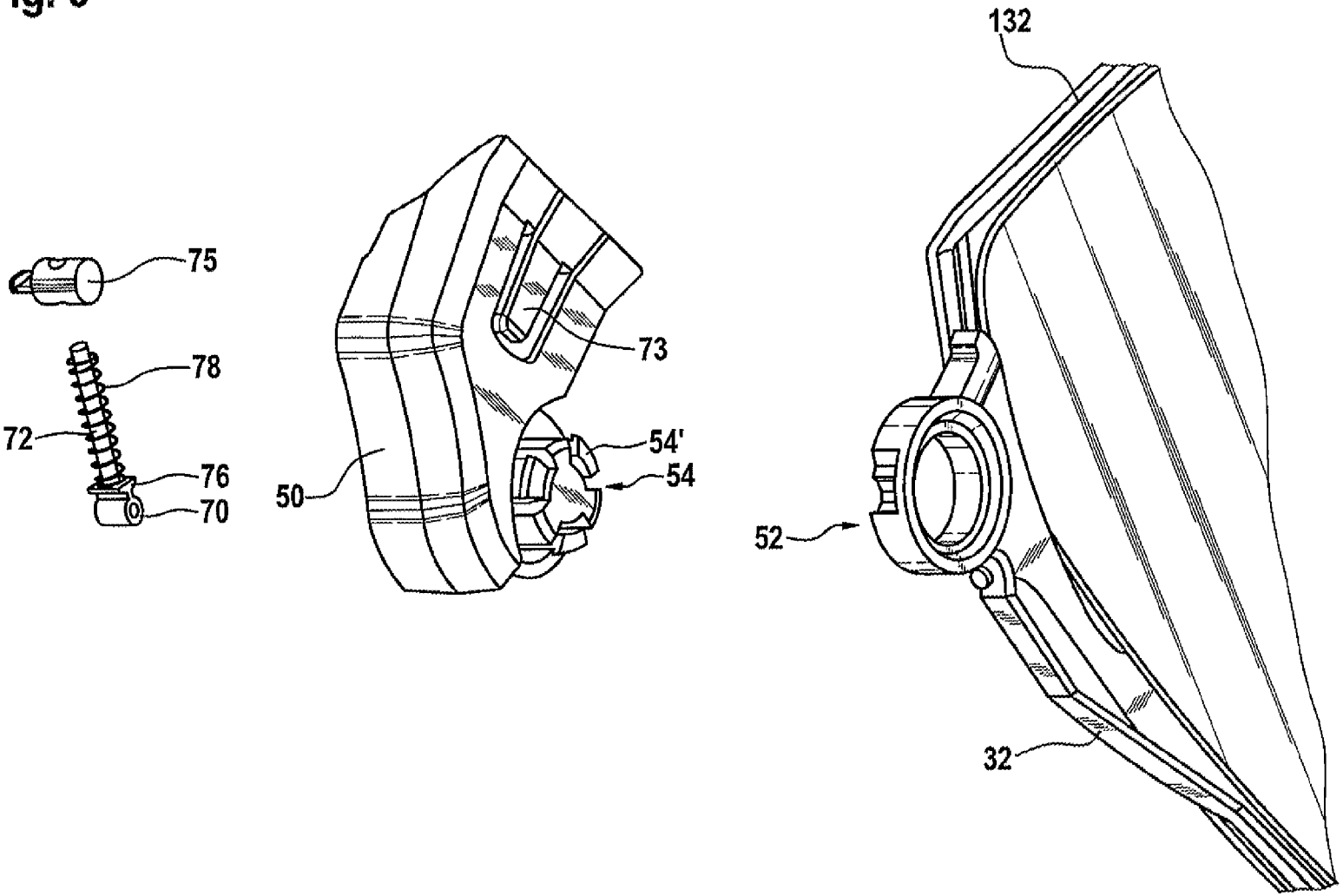
Figure 7:
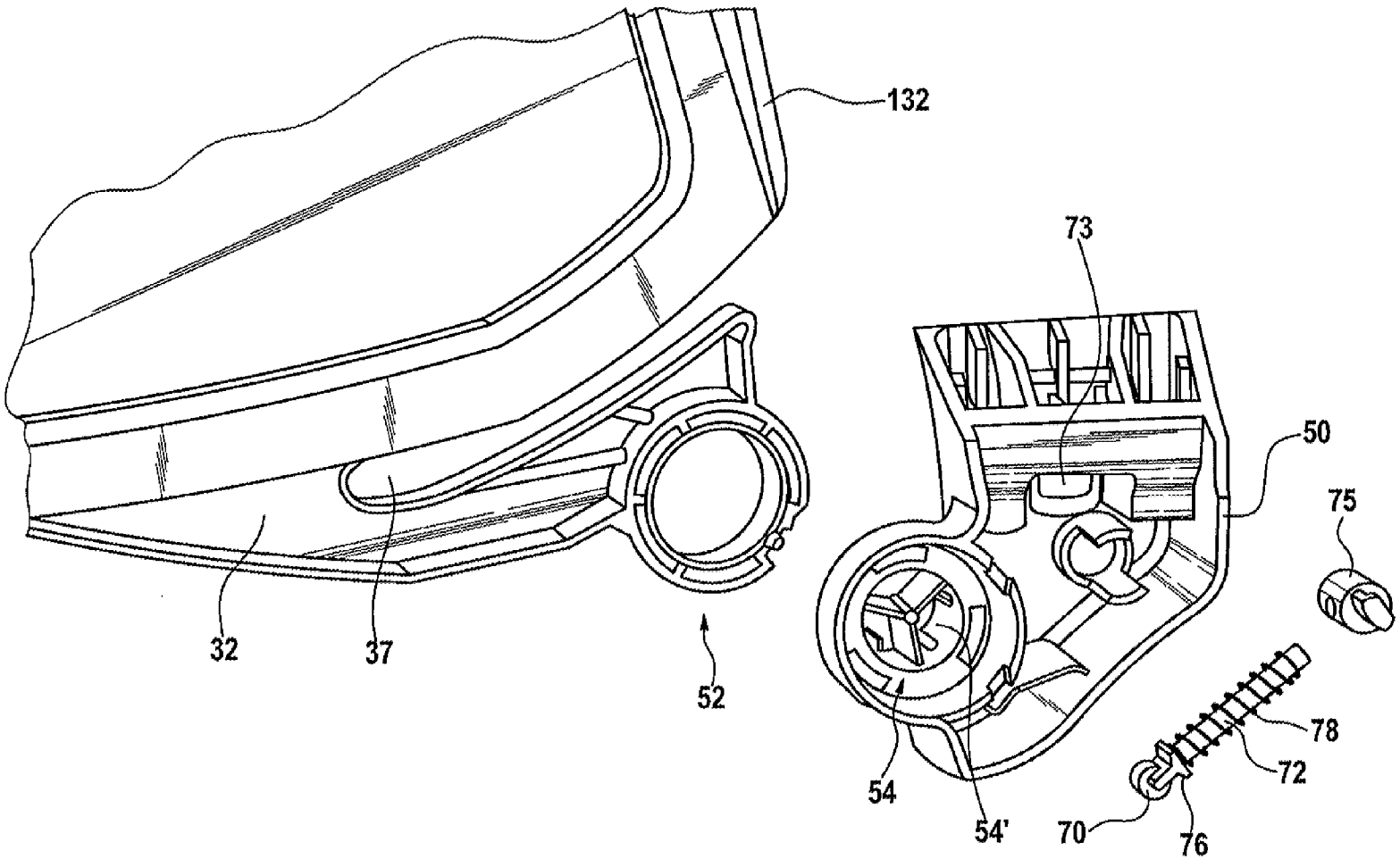
Figure 8:
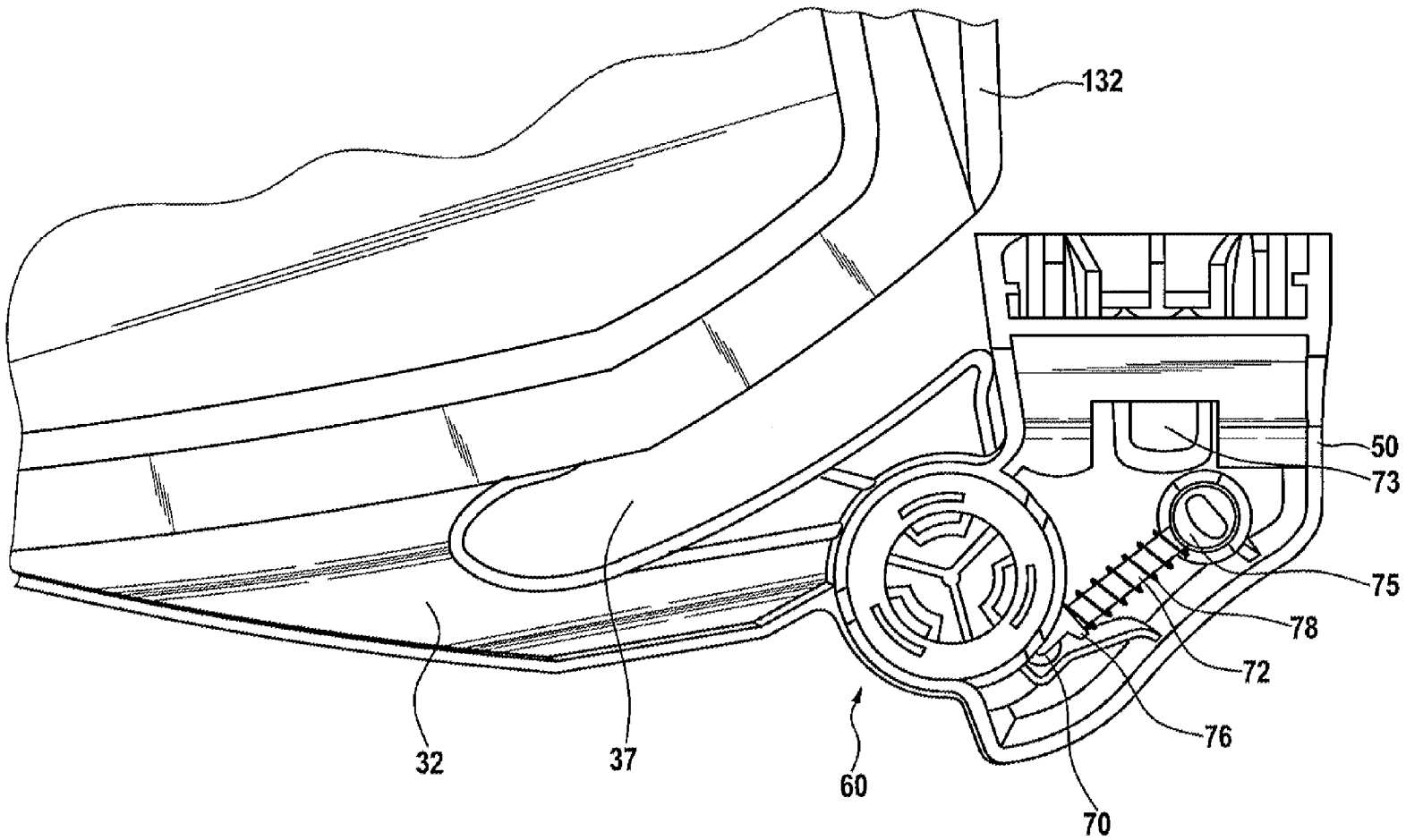
Figure 9:
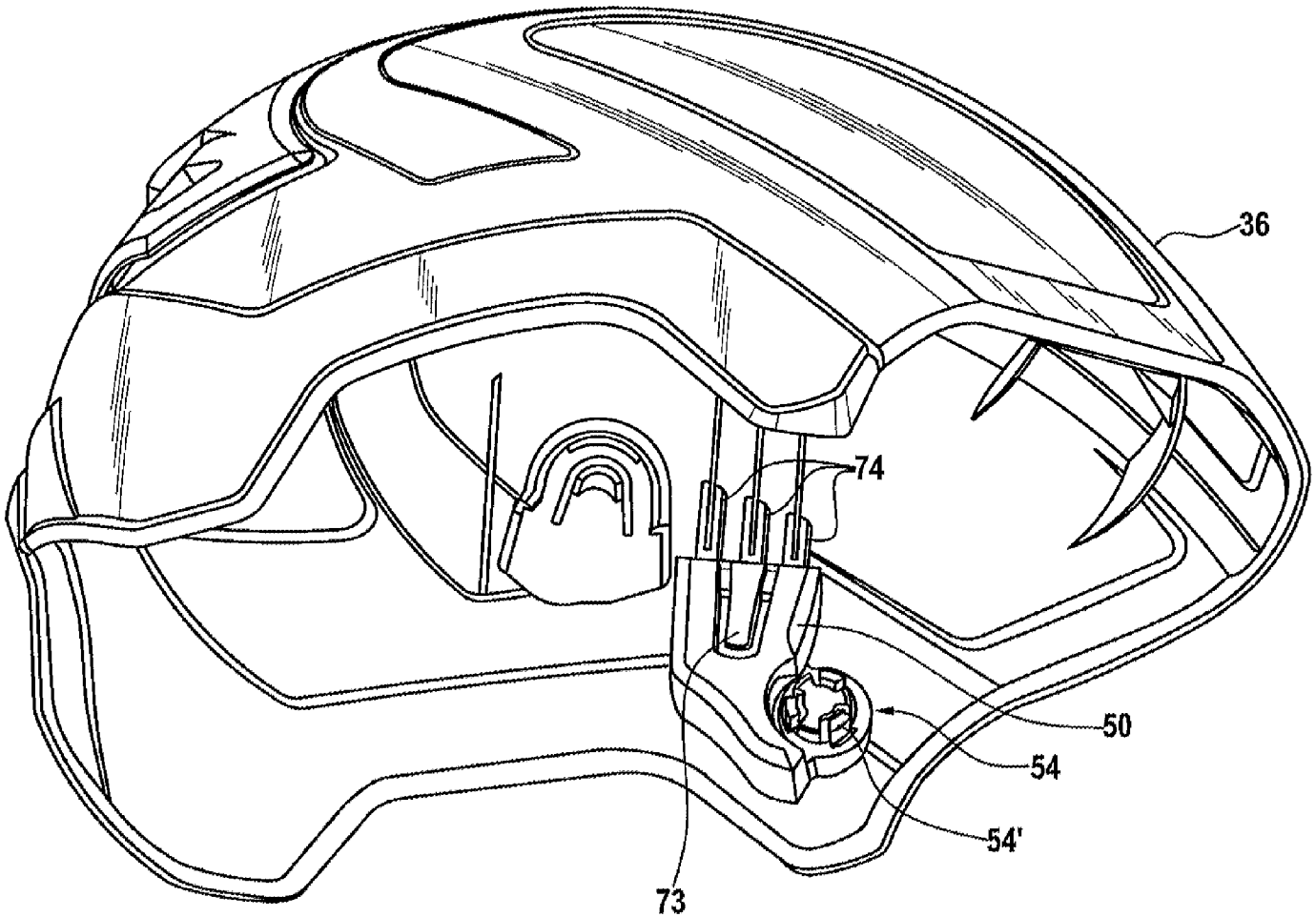

Embodiments of the invention will be described in more detail below with reference to the drawings in which:

FIG. 1 shows a side view of a protective helmet comprising a face protection according to the invention, the visor being shown when pivoted upwards into a parking position, FIG. 2 shows a sectional view of the protective helmet according to FIG. 1 when viewed in a rearward direction, FIG. 3 shows a broken view of the protective helmet according to FIG. 1 when viewed in a forward direction, FIG. 4 shows the protective helmet according to FIG. 1, the visor being pivoted downwards into an operating position, FIG. 5 shows, as a detail, a support joint connecting a support arm of the visor and a bearing device, the visor being shown when pivoted downwards into the operating position, FIG. 6 shows the support joint according to FIG. 5 as a detail and in an exploded view when regarding the bearing device from the inside, FIG. 7 shows the support joint according to FIG. 5 in an exploded view when regarding the rear side of the bearing device in the direction from the outside to the inside and a ring bearing bushing of a retaining arm of the visor, FIG. 8 shows, as a detail, a support joint connecting a retaining arm of the visor and a bearing device, the visor being pivoted upwards into a parking position, and FIG. 9 shows the snap-on mount of the bearing device according to FIG. 6 on the inside of a helmet shell shown without the interior fittings in an inclined view from below.

An embodiment of a protective helmet designed particularly for use in forestry and designated by 30 as a whole is shown in a side view in FIG. 1, in a front view in FIG. 2, in a rear view in FIG. 3, and, in addition, in a side view in FIG. 4. The protective helmet 30 comprises face protection according to the invention designated by 33 as a whole comprising a visor 132 which is shown when pivoted upwards into a parking position in FIG. 1 and when pivoted downwards into an operating position in FIG. 4. Since the bearing devices of the face protection 33 are formed identically in a laterally reversed manner on both sides of the helmet 30, no difference will be made between the right and left bearing devices, supporting joints, retaining arms, etc. in the following description.

The visor 132 of the face protection 33 comprises, on each side of the helmet 30, a retaining arm 32 as well as a bearing device 50 formed as a connector on which a part of a support joint 60 is integrally formed. The bearing device 50 of each retaining arm 32 is fixed on the inside of a helmet shell 36. Each bearing device 50 is formed as a part of a plug-in coupling which can be snapped onto the other part of the plug-in coupling mounted on the inside of the helmet shell 36. This other part of the plug-in coupling is, according to the illustration in FIG. 9, comprised of a plurality of rod-like protrusions 74 integrally formed on the inside of the helmet shell 36 and also shown in FIG. 2 in which, however, the bearing device 50 is not shown. The bearing device 50 is mounted on the rod-like protrusions 74 whereby a support joint 60 of the visor 132 comes to be positioned in each temple section on the inside of the helmet shell 36. In FIGS. 1, 4 and 9 the bearing device 50 can be seen when mounted to the inside of the helmet shell 36. The design of the support joint 60 will be described in more detail below with reference to FIGS. 5-9.

The retaining arm 32 is integrally formed at one end on the rear side of a frame of the visor 132 as can be seen in FIGS. 5-8. At the free end of the retaining arm 32 a ring bearing bushing 52 is formed. Each bearing device 50 comprises a bearing pivot 54 for accommodating the ring bearing bushing 52. Each bearing device 50 is formed as a connector or as a part of an aforementioned plug-in coupling which can be mounted on the other part the plug-in coupling mounted on the inside of the helmet shell 36 and comprised of the rod-like protrusions 74 according to FIG. 9. In each connector receptacles are formed which accommodate the ends the rod-like protrusions 74 which protrude downwards as can be seen in FIG. 9. A resilient finger 73 establishes a snap-on connection between the bearing device 50 and the helmet shell 36. Der bearing pivot 54 of each plug-in coupling part comprises axially protruding, elastically flexible tappets 54' onto which the ring bearing bushing 52 can be snapped. In FIGS. 5 and 8 the two parts of the support joint 60, namely the ring bearing bushing 52 and the bearing pivot 54, are illustrated in an assembled state while they can be seen in an exploded view in FIGS. 6 and 7. The retaining arm 32 extends from the visor 132 to its free end connectable or connected to the bearing device 50 substantially parallel and in such a distance to the visor 132 that a slot 37 is formed between the retaining arm 32 and the visor 132 through which the helmet shell 36 extends in the parking position as shown in FIG. 1, and that the visor 132 is positioned on the outer surface of the helmet shell 36 so as to be tightly abutting on it in the parking position as also shown in FIG. 1 and particularly in FIGS. 2 and 3.

A spring-biased locking element 70 engages in the ring bearing bushing 52 from the outside and is entrainable by the ring bearing bushing 52 when the visor 132 is pivoted up or pivoted down so as to releasably and positively retain the visor 132 in its one or other position. The two positions of the spring pre-stressed locking element 70 are shown in FIGS. 5 and 8 in which the visor 132 is positioned in the operating position or in the parking position. The spring pre-stressed locking element 70 comprises a roll rotatably supported at end of a rod 72, the other end of the rod 72 extending through a pivot bearing 75 so as to be shiftable and a pressure spring 78 for generating the spring preload being supported on the rod 72 between the pivot bearing 75 and a shoulder 76.

According to the illustration in FIG. 7, an axially protruding small pin is present in the ring bearing bushing which, after the assembly of the ring bearing bushing and the pivot pin 54, positively engages in a recess in the locking element 70 not shown in FIG. 7. This is the reason why the locking element 70 is entrained by the visor 132 when it is pivoted.

The invention claimed is:

1. A face protection to be fastened to a protective helmet, comprising a visor comprising two retaining arms and two bearing devices for the retaining arms which are attachable to a helmet shell of a helmet for pivoting the visor between two positions, an operating position in which the visor is pivoted downwards and protects the face, and a parking position in which the visor is pivoted upwards, wherein each bearing device is designed to be fastened to the inside of the helmet shell, and in that each retaining arm extends from the visor to its free end connectable or connected to the bearing device substantially parallel to and in such a distance to the visor that a slot is formed between the retaining arm and the visor through which slot the helmet shell extends in the parking position, and wherein the visor is, in the parking position, arranged close-fitting on the outer surface the helmet shell;

wherein each retaining arm is formed as a ring bearing bushing at its free end, and wherein each bearing device is provided with a bearing pivot for accommodating the ring bearing bushing; and wherein each bearing device is formed as a part of a plug-in coupling pluggable on the other part of the plug-in coupling installed on the inside of the helmet shell.

2. The face protection according to claim 1, wherein the bearing pivot of each plug-in coupling part comprises axially protruding, elastically flexible tappets on which the ring bearing bushing can be snapped.

3. The face protection according to claim 1, wherein a spring-biased locking element engaging in the ring bearing bushing from the outside and entrainable by the ring bearing bushing to releasably and positively retain the visor in its one or other position.

4. A face protection to be fastened to a protective helmet, comprising a visor comprising two retaining arms and two bearing devices for the retaining arms which are attachable to a helmet shell of a helmet for pivoting the visor between two positions, an operating position in which the visor is pivoted downwards and protects the face, and a parking position in which the visor is pivoted upwards, wherein each bearing device is designed to be fastened to the inside of the helmet shell, and in that each retaining arm extends from the visor to its free end connectable or connected to the bearing device substantially parallel to and in such a distance to the visor that a slot is formed between the retaining arm and the visor through which slot the helmet shell extends in the parking position, and wherein the visor is, in the parking position, arranged close-fitting on the outer surface the helmet shell;

wherein each retaining arm is formed as a ring bearing bushing at its free end, and wherein each bearing device is provided with a bearing pivot for accommodating the ring bearing bushing;

wherein a spring-biased locking element engaging in the ring bearing bushing from the outside and entrainable by the ring bearing bushing to releasably and positively retain the visor in its one or other position; and wherein the spring-biased locking element comprises a roll rotatably supported at one end of a rod, the other end of the rod extending through a pivot bearing and a pressure spring for generating the spring-preload being positioned on the rod between the pivot bearing and the roll.

* * * * *